US006652080B2

(12) United States Patent
Childs et al.

(10) Patent No.: US 6,652,080 B2
(45) Date of Patent: Nov. 25, 2003

(54) RE-CIRCULATING FLUID DELIVERY SYSTEM

(75) Inventors: Ashley E. Childs, Corvallis, OR (US); Louis C. Barinaga, Salem, OR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 7 days.

(21) Appl. No.: 10/137,520

(22) Filed: Apr. 30, 2002

(65) Prior Publication Data

US 2003/0202057 A1 Oct. 30, 2003

(51) Int. Cl.[7] ..... B41J 2/175; B42J 2/18
(52) U.S. Cl. ..... 347/85; 347/89
(58) Field of Search ..... 347/85, 86, 87, 347/89, 92

(56) References Cited

U.S. PATENT DOCUMENTS 4,462,037 A * 7/1984 Bangs et al. ..... 47/89
5,751,300 A 5/1998 Cowger et al. ..... 347/6
5,847,736 A 12/1998 Kanbayashi et al. ..... 347/89
5,936,650 A 8/1999 Ouchida et al. ..... 347/89
6,048,057 A * 4/2000 Kanemoto et al. ..... 347/88
6,152,559 A * 11/2000 Kojima ..... 347/89
6,196,651 B1 3/2001 Zuber et al. ..... 347/7
6,352,331 B1 3/2002 Armijo et al. ..... 347/19

FOREIGN PATENT DOCUMENTS

JP 10-029317 A * 2/1998 ..... B41J/2/175

* cited by examiner

*Primary Examiner*—Anh T. N. Vo

(57) ABSTRACT

A fluid delivery system includes a print cartridge and a fluid supply. The print cartridge includes a housing structure, an air-fluid separator structure within the housing structure, including an air vent region in communication with the seperator structure. A fluid ejector is mounted to the housing structure, and a fluid plenum within the housing structure is in fluid communication with the fluid ejector. A fluid reservoir in the housing structures is in fluid communication with the plenum for supplying fluid to the plenum under negative pressure. A fluid re-circulation path is provided in the housing structure through the separator structure and the fluid plenum. A pump structure re-circulates fluid and air through the re-circulation path during a pump mode. The fluid supply is continuously or intermittently fluidically coupled to the fluid reservoir.

40 Claims, 7 Drawing Sheets

RE-CIRCULATING FLUID DELIVERY SYSTEM

BACKGROUND OF THE DISCLOSURE

Regulator-based ink jet print cartridges are designed to handle air in the system that is left in the pen from manufacturing, air that enters during supply actuation, and air that is delivered to the pen from the ink supply. The air in the system is stored in the cartridge body and grows over time by diffusion; therefore, the cartridge has a limited lifetime before air causes failure. Storing air (also known as warehousing air) in the cartridge requires a large internal volume in which to accommodate air accumulation. These systems cannot be scaled down in size without compromising their useful life.

Methods of purging air from the cartridge body include purging air and ink through the nozzles, purging air and ink from another location besides the nozzles, and purging air only through an air permeable membrane that is impervious to ink. For all these methods except the membrane solution, a tank to store the wasted ink is required, which consumes a large volume in the printer, increasing its overall size. The membrane solution requires a very robust material that must last a lifetime of the pen, and because the material is very thin, these properties are difficult to achieve and therefore also make the material difficult to assemble into a cartridge.

Re-circulating ink delivery systems are inherently air tolerant. These types of systems move air and ink from the print head region of the pen, separate them in either a foam block or by gravity, and circulate the ink back to the print head. The driving force of the re-circulation is generally the same as that to deliver ink.

SUMMARY OF THE DISCLOSURE

A fluid delivery system is disclosed. In an exemplary embodiment, the system includes a print cartridge and a fluid supply. The print cartridge includes a housing structure, an air-fluid separator structure within the housing structure, including an air vent region in communication with the separator structure. A fluid ejector is mounted to the housing structure, and a fluid plenum within the housing structure is in fluid communication with the fluid ejector. A fluid reservoir in the housing structure is in fluid communication with the plenum for supplying fluid to the plenum under negative pressure. A fluid re-circulation path is provided in the housing structure through the separator structure and the fluid plenum. A pump structure re-circulates fluid and air through the re-circulation path during a pump mode, wherein air bubbles may be separated from re-circulated fluid and vented to atmosphere from the air vent region. The fluid supply is continuously or intermittently fluidically coupled to the fluid reservoir.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
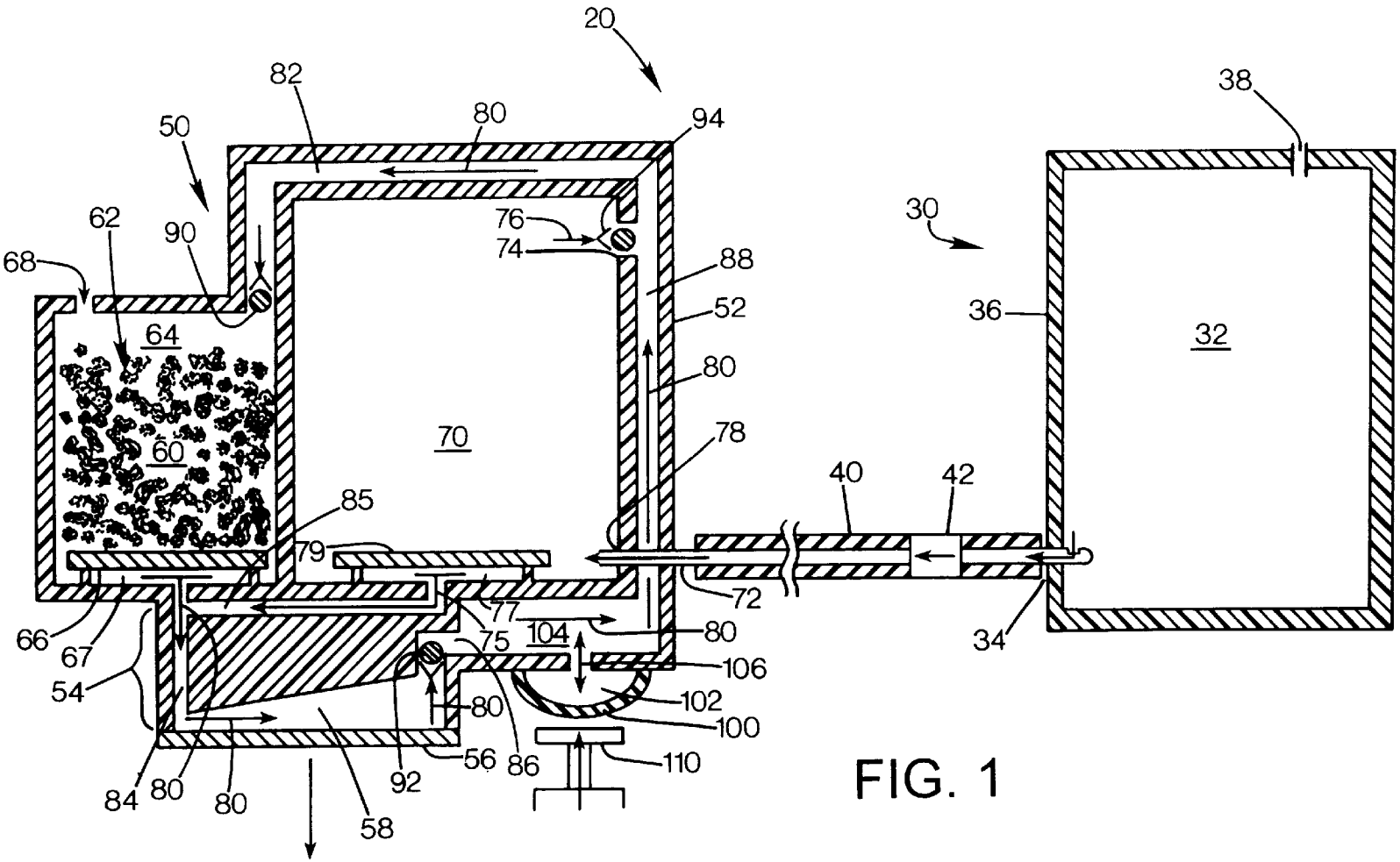
FIG. 1 is a simplified, diagrammatic cross-sectional view of an embodiment of a fluid delivery system.

FIG. 1 is a simplified, diagrammatic cross-sectional view of an embodiment of a fluid delivery system 20, comprising an ink or fluid supply 30 located off the printer carriage, i.e. mounted "off-axis." The fluid supply 30 is connected to a print cartridge 50 by a fluid conduit or tube 40, typically fabricated of a flexible material impervious to the fluid. In this embodiment, the fluid supply holds a supply of fluid at an ambient pressure, i.e. the fluid supply does not provide the fluid at a negative gage pressure. The fluid supply 30 includes a reservoir 32 having an outlet port 34 at which an end of the tube is connected. The reservoir 32 can be defined by a sealed flexible bag, by a rigid outer casing 36 with a vent 38, or other suitable structures.

The print cartridge 50 includes a body structure 52 fabricated of a rigid material such as liquid crystal polymer (LCP), marketed by Ticona, Summit, N.J., PPS, PET or ABS, and defines a standpipe region 54, to which a printhead 56 is mounted. The printhead 56 can be a thermal inkjet nozzle array, a piezoelectric print head, or other fluid ejecting apparatus. A fluid plenum 58 is disposed adjacent the printhead 56 for supplying fluid to the fluid ejecting apparatus. There are two fluid sources for delivering fluid to the plenum. One source is from a capillary chamber 60 in which a body 62 of capillary material is disposed, to form an air/fluid separator structure. The second source is from a free fluid reservoir structure 70 which maintains the fluid under a negative gage pressure, in this exemplary embodiment a spring bag reservoir structure 70. Each of the sources will be described in further detail below.

The print cartridge includes a pump structure 100, which in this exemplary embodiment is a diaphragm pump structure that includes an elastomer material formed into a convex shape with an internal spring that rebounds the pump volume after the elastomer is pushed in by an external driving force. The diaphragm encloses a pump chamber 102, which communicates through opening 106 formed in the housing structure wall with a chamber 104. The pump diaphragm is actuated by an external pump actuator 110 in this exemplary embodiment, to substantially reduce the chamber 102 volume on an in-stroke in a pump cycle, forcing fluid in the chamber through the opening 106 into chamber 104.

The print cartridge 50 includes internal fluid channels which define a fluid circulation path indicated generally by arrows 80. The fluid channels include channels 82, 84, 86 and 88, arranged in a generally peripheral path about the interior of the body structure 52. Check valves 90 and 92 are positioned in the fluid path, with valve 90 positioned at a top inlet port of the capillary chamber 60, and valve 92 in an outlet port of the fluid plenum. Each of these valves is a oneway fluid flow control valve, which permits fluid flow only in the direction indicated by arrows 80 when the differential fluid pressure exceeds the cracking pressure of the respective valve.

The capillary chamber 60 has disposed therein a body 62 of capillary material, such as bonded-polyester fiber foam, polyurethane foam or glass beads. The capillary material 62 acts as a fluid/air separator. This function is achieved by the hydrophilic capillary material absorbing the fluid, but not the air. An air vent region 64 is provided above the capillary body 62, and provides a small volume of humid air above the capillary material that is vented to atmosphere via a labyrinth vent 68. A filter 66 separates the capillary material 62 from region 67, which transitions into fluid channel 84. The filter 66 can be fabricated, e.g, from a fine mesh screen.

Figure 2:
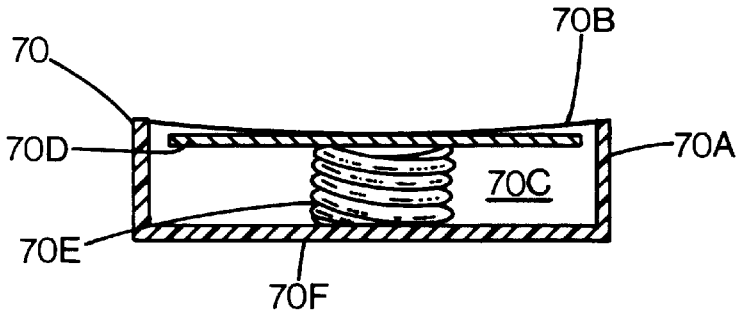
FIG. 2 is a diagrammatic side cross-sectional view of an embodiment of a spring bag structure, usable in the system of FIG. 1.

The structure 70 in an exemplary embodiment is a spring bag structure, diagrammatically depicted in the side cross-sectional illustration of FIG. 2. A housing 70A, which can be provided by body structure 52, or formed as a separate structure, is a generally closed structure with an open side to which is sealed, e.g. by heat staking a flexible film 70B. The film is impervious to the fluid delivered by the print cartridge, and can be, e.g. a viscoelastic deformable, multi-layer film fabricated from polyethylene and SARAN (™). A thin plate, formed from rigid material such as stainless steel, LCP or ULTEM (™), the latter a product marketed by General Electric Plastics, is positioned between the film and a biasing structure 70E which urges the plate and film away from the bottom side wall 70F. The biasing structure can be a coil or leaf spring, by way of example. The fluid is contained within the chamber 70C by the film.

Referring again to FIG. 1, the structure 70 includes a purge port 74 which communicates with the channel 88 through a third check valve 94, which permits one-way fluid flow in the direction of arrow 76 from the chamber 70C to the channel 88 and fluid circulation path 80. The structure 70 further includes an inlet port 78 to which an isolated fluid passage defined by a conduit 72 communicates. The cartridge end of the tube 40 is connected to an inlet port 72 fluidically coupled to the chamber 70. Thus, fluid can pass from the supply reservoir 32 through tube 40 and inlet port 72 into the chamber 70 to replenish the fluid supply within the chamber 70.

The structure 70 has an output port 75 in communication with fluid channel 85, a filter 79 and a chamber 77. Fluid is maintained in chamber 70C under back pressure, i.e. negative gage pressure, due to the action of the spring. Fluid is drawn, under suitable pressure conditions, from the chamber 70C through the filter 79 into chamber 77 and then through the fluid channel 85 to a junction with channel 84. The capillary chamber 60 and the spring bag chamber 70C are thus in fluid communication through the channels, 84, 85 and filters 66, 79. Thus, under static conditions, a pressure balance will exist between the respective chambers.

The volume of the capillary chamber 60 can be relatively small compared to the volume of the chamber 70C. A primary function of the capillary chamber is to provide a fluid-air separator function, and this permits the chamber to be of relatively smaller size.

During fluid extraction, i.e. when the printhead 56 is activated to eject fluid droplets, fluid will be taken from the spring bag structure or regulator module 70, although a relatively small amount may be taken from the capillary chamber 60 if the capillary structure 62 is not in a fluid depleted state during slow print rates, i.e. conditions of low fluid flux. During periods of high fluid flux, fluid will be supplied from the spring bag structure or regulator module 70.

The pump 100 when actuated by a reciprocating actuator 1 10 circulates fluid through the fluid path 80, driving the fluid to re-circulate from the spring bag and the fluid channels. Thus, on the in-stroke of the actuator and diaphragm 100, the chamber 102 is collapsed, forcing fluid through port 106 into the chamber 104 and thus into the fluid channels 88, 82. As this occurs, the cracking pressure of check valve 90 is exceeded, opening the valve and allowing fluid and accumulated air bubbles to enter the chamber 60. Valves 92 and 94 remain in a closed state. Air bubbles are separated from the fluid at the interface of the capillary material, collecting in the space 64 and being vented to atmosphere through vent 68. This will replenish the fluid in the capillary structure, while separating the air bubbles from the fluid.

On the pump actuator out-stroke, the diaphragm 100 expands, drawing fluid into the chamber 102 from the chamber 104 and the fluid passages. As this occurs, the cracking pressures of valves 92 and 94 are exceeded, opening these valves to fluid flow, while valve 90 closes. With valve 94 open, air bubbles and some fluid are purged from the chamber 70C into channel 88. Fluid is also drawn through valve 92 from plenum 58 and from the outlet port of the chamber 70C into chamber 104. Fluid may also be drawn into the chamber 70C through the tube 40 and the inlet valve 42 from the fluid supply 30, depending on the fluid back pressure in chamber 70C.

After the pumping ceases, the chamber 60 may be over-filled with fluid, such that the capillary material is in a saturated state and the back pressure at the outlet to the chamber 60 is relatively low. Under static conditions, the pressures in chambers 60 and 70C will equalize, however, since the two chambers are fluidically connected through the channels 84 and 85 and the respective filters 66 and 79. Thus, some fluid may flow from chamber 60 to chamber 70C to achieve the pressure balance.

The number of pump cycles can be monitored, to prevent over-filling the structure 70. This can be done by the printer controller, in an exemplary implementation. The pump cycle will typically be done infrequently, when it is desired to purge air from the cartridge.

The system can also be set up, by appropriate selection of the check valve break pressures and the pressure drops through the filters and the fluid channels, so that the cartridge 50 will automatically cease drawing fluid from the supply 30 as the supply of fluid in the chambers 60 and 70C is replenished. This will occur due to the decrease in negative pressure in the chamber 70C, which will result in a differential fluid pressure across valve 42 which is below its break pressure.

An exemplary break pressure for the inlet valve 42 is −8 inches of water, so that the chamber 70C will also have a negative pressure of −8 inches of water. Chamber 60 in an exemplary embodiment has a negative pressure range between −1 inch of water, for an over-filled condition, and −4 inches of water, for a depleted condition. The chamber 70C and chamber 60 will equalize in pressure under static conditions.

In a typical application, the pump actuator will be located at a service station location, such that when the carriage holding the print cartridge is moved to a service position, the actuator is adjacent the pump diaphragm on the print cartridge. Other arrangements could alternatively be employed.

In the embodiment illustrated in FIGS. 1–2, the fluid supply 30 is continuously connected to the print cartridge via the tube 40 during normal printing operations, and during the pump mode.

The exemplary fluid supply 30 in the embodiment of FIG. 1 does not provide back pressure to tend to prevent fluid from drooling out its outlet port. A fluid interconnect such as a needle-septum interconnect will typically be used to prevent fluid drool. The inlet valve 42 is provided in this embodiment to set the back pressure in the spring bag structure 70. The valve 42 can be a pressure activated or mechanically activated fluid control valve, and can be located in the tube, a fluid manifold, in the fluid supply, or on-axis, e.g. at the spring bag structure inlet 72. The valve 42 opens only when a pressure differential exceeds a break pressure, in the case of a pressure activated embodiment, or when mechanically actuated. By way of example, a valve could be actuated by the plate 70D, with the plate contacting a valve actuator as the plate nears the bottom wall 70F of the structure 70. As the plate is drawn towards the bottom wall against the bias of the spring 70E, the back pressure in the chamber 70C increases. By opening the valve 42, either by pressure actuation or by mechanical actuation, fluid will be released into the chamber 70C from supply 70, thus reducing the back pressure of the fluid within the chamber. By appropriate selection of the valve break pressure or position of the valve actuator, the back pressure operating range of the spring bag structure can be established to provide good print quality. Back pressure regulators with a compliant wall and a regulator valve are described in co-pending application Ser. No. 09/748,059, entitled APPARATUS FOR PROVIDING INK TO AN INK JET PRINT HEAD.

Figure 2A:
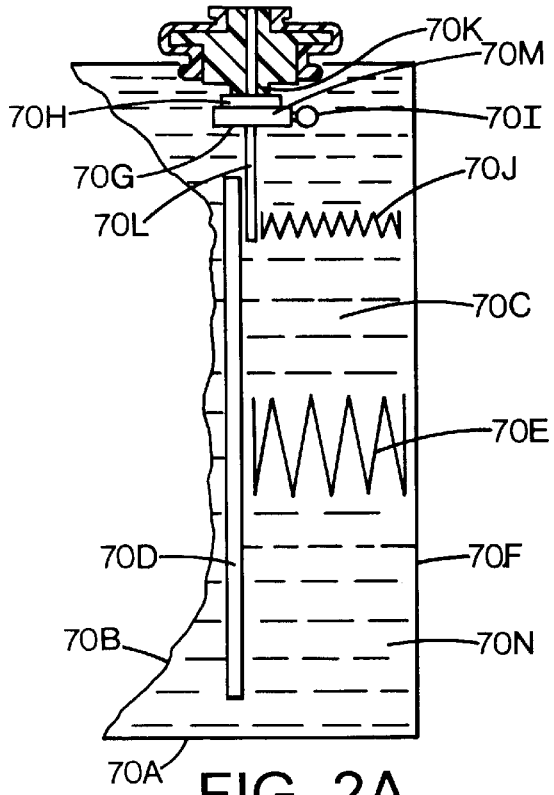
FIG. 2A is a diagrammatic side cross-sectional view of an alternate embodiment of a spring bag structure which includes a mechanically actuated inlet valve.
Figure 2B:
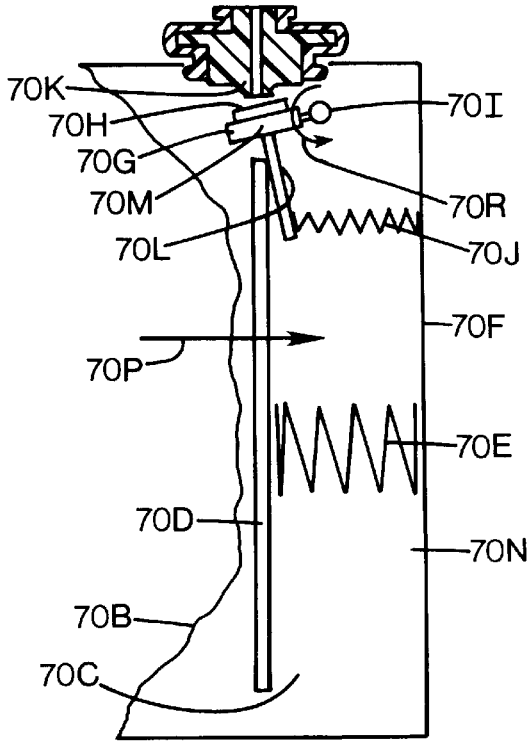
FIG. 2B is similar to FIG. 2A, but showing the inlet valve in the open condition.

FIGS. 2A and 2B illustrate an alternate embodiment of a spring bag structure 70 which includes a mechanically actuated inlet valve indicated generally as reference numeral 70G, to form a pressure regulator structure or module. The ink inlet valve includes a rigid plastic part with an elastomeric portion overmolded thereon. The inlet valve has a rigid, elongate valve stem 70L which is an elongate portion of the valve that is continuously engaged by a pre-load spring 70J. During printing, it engages plate 70D to admit ink into the pressure regulator cavity 70C. The plate and valve stem are not mechanically coupled; thus they can be operatively disengaged when the inlet valve is shut. This feature allows for compensation for any air entrapped in structure 70. The inlet valve 70G further includes a valve seat pocket 70M rigidly formed with the valve stem 70L. The valve seat pocket is orthogonal to the longitudinal axis of the valve stem 70L. Bonded to the upper surface of the valve seat pocket is an elastomeric, resiliently deformable valve seat 70H. The valve seat is fabricated from flurosilicone or EPDM. The valve seat is rotatable about axle 701, and seals and unseals a valve nozzle 70K and allows ink to enter the chamber 70C as needed to maintain the pressure of the ink delivered to the print head. Contact with the spring 70J and with the plate 70D causes the inlet valve 70G to rotate about the valve axle 701 and the valve seat 70H to block and unblock the valve nozzle 70K.

In FIG. 2A, the pressure regulator is at steady state and ready to operate. This is the usual condition of the print cartridge. The pressure regulator is filled with fluid 70N and the ink is at a negative pressure. The spring 70E is urging the plate 70D against the film 70B. The outside of the regulator and the exterior surface of the compliant wall 70B are at ambient pressure. The spring 70J is urging the inlet valve 70G shut so that the valve nozzle 70K is blocked.

Figure 3:
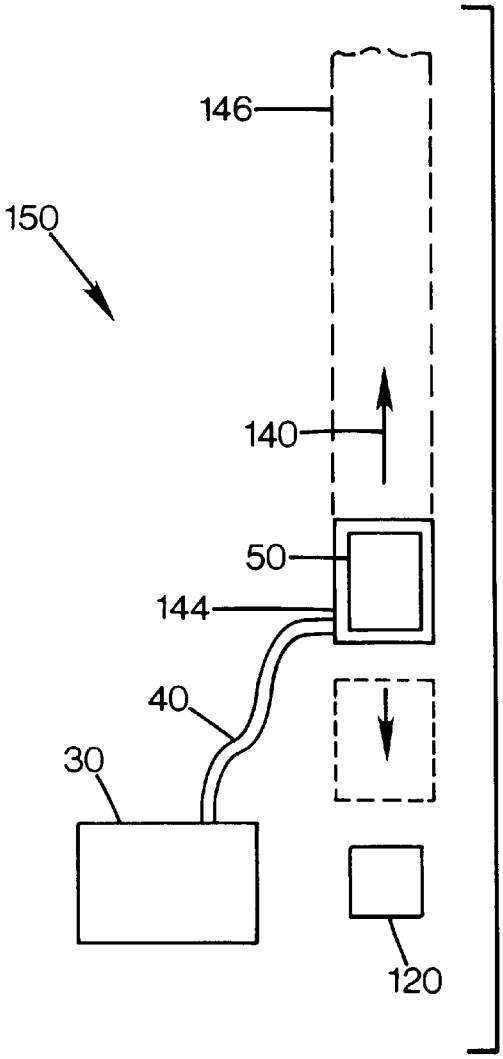
FIG. 3 is a schematic block diagram of an exemplary embodiment of a printing system embodying aspects of the invention.

On command, the printer starts to print and the print head 56, FIG. 3 fires in the conventional manner so that droplets of fluid are jetted onto a printing medium. The jetting of fluid by the print head 56 causes the pressure in the regulator to decrease. In turn the ambient air pressure forces the film 70B and pressure plate 70L back against the spring 70E. In effect, the film collapses against the spring due to the differential pressure across the compliant wall 70B. This motion is indicated by the arrow 70P, FIG. 2B.

The pressure in the regulator continues to decrease as the print head 56 jets fluid until the plate 70D contacts the valve stem 70L on the inlet valve 70G. The plate overcomes the urging of the spring 70J, causing the inlet valve 70G to rotate about the valve axle 701, to move the valve seat 70H away from the valve nozzle 70K, and to unblock the valve nozzle. This rotary motion about the valve axle is indicated by the arrow 70R (FIG. 2B). Fluid now flows into the chamber 70C, the pressure of the fluid in the chamber increases, and the regulator returns to the condition illustrated in FIG. 2A. The blocking and unblocking of the valve nozzle 70K, the rocking back and forth of the inlet valve 70G, and the filling of the regulator with ink are steps that are repeated over and over in order to provide ink to the back of the printhead 56 at the desired operating pressure.

The valve stem 70L on the inlet valve is positioned in the regulator so the contact between the valve stem and the plate 70D only occurs after the plate has displaced the spring 70E by some clearance distance. This allows the print cartridge to compensate for air entrapped in the structure 70 regulator because the valve stem 70L and plate 70D are not mechanically coupled together.

In other embodiments, the valve 42 can be omitted. For example, a capillary structure can be provided in the supply 30 to provide fluid back pressure. In another embodiment, the back pressure can be set by the head height set by the relative location of the fluid supply 30 relative to the print head 56, e.g. by placing the supply 30 lower than the print head height to thereby set the negative pressure.

FIG. 3 is a schematic diagram of an inkjet printer 150 embodying aspects of the invention. The print cartridge 50 is mounted in a traversing carriage 144 of the system, which is driven back and forth along a carriage swath axis 140 to print an image on a print medium located at the print zone indicated by phantom outline 146. The fluid supply 30 is mounted off the carriage, i.e. "off-axis," at a supply station. During printing, the fluid supply 30 is continuously connected to the print cartridge 50. After printing, at a time determined by the printer controller, the carriage 144 is slewed along axis 140 to a service location in the printer, at which is disposed the pump actuator 120. The diaphragm 100 (FIG. 1) is then pressed upwardly by a piston comprising the actuator 120, creating a positive gage pressure buildup in the chamber 104 and fluid channels 82, 88. The pressure builds until the cracking pressure of the valve 90 is reached; consequently, fluid and accumulated air flows through the valve 90 onto the capillary material 62. Air separated from the fluid is released into the free space 64 above the capillary material. This space is ventilated via the labyrinth vent 68, so the air is allowed to escape to the atmosphere. The fluid that absorbs into the depleted capillary material replenishes the fluid volume in the material, which lowers its back pressure.

Immediately after the pump is pressed, the piston 120 is retracted to allow the pump diaphragm 100 to return to its original shape. This return can be achieved by several techniques. One exemplary technique is to build structure into the shape of the pump, so that the inherently rigidity of the structure will cause it to rebound. Another technique is to use a spring which reacts against the deformation of the piston, returning the pump to its original shape. A diaphragm pump suitable for the purpose is described in co-pending application Ser. No. 10/050,220, filed Jan. 16, 2002, OVER-MOLDED ELASTOMERIC DIAPHRAGM PUMP FOR PRESSURIZATION IN INKJET PRINTING SYSTEMS, Louis Barinaga et al., the entire contents of which are incorporated herein by this reference.

During the return stroke of the pump chamber, the back pressure builds in the chamber 104. After a certain magnitude of buildup, the valve 92 cracks open and allows fluid to flow in to the chamber 104 from the plenum 56. The flow of fluid from the circulation path 80 is limited due to dynamic pressure losses associated with the capillary material (still in a depleted state), filter 66, the fluid channels, and recirculation valves. Because of this loss, back pressure continues to build in the chamber 104 due to further return (expanding) of the pump diaphragm. If the back pressure builds high enough, the purge valve 94 of the spring bag structure will crack open, allowing the fluid flow into the fluid path 80 and channel 88. Depending on the negative pressure in the spring bag chamber, the valve 42 may open, to allow fluid flow into the chamber 70C from supply 30.

After the diaphragm 100 returns to its initial position, the piston 110 again cycles the pump. The number of cycles for a purge/refill operation can be limited to prevent over-filling the print cartridge, if the break pressures of the check valves are not selected to achieve a pressure balance which shuts off the valve 42 before overfilling occurs. Alternatively, as noted above, the break pressures can be appropriately selected to achieve a pressure balance in the print cartridge which will cause the valve 42 to close before overfilling occurs. In this case, the same steps as described above would result from the cycles subsequent to the first pump cycle, but there is a key difference between successive cycles. As the cycles continue, the capillary material 62 becomes less depleted due to the influx of fluid. This reduction in depletion reduces the amount of dynamic pressure loss associated with the capillary material, and the fluid velocity through the fluid channels comprising the circulation path 80 increases. With the increased fluid flow through the fluid channels comes an increase in fluid channel loss. However, in this exemplary embodiment, the capillary material is selected so that the capillary pressure loss drops more quickly than the fluid channel loss increases. As a result, the pressure loss associated with the circulation path is reduced in magnitude. This reduction in pressure loss means that the circulation path through the capillary structure becomes more and more capable of fulfilling all of the flow required by the return stroke of the pump, and less fluid will be supplied from the spring bag structure. After the desired amount of fluid has entered the capillary material, the pump mode is stopped. At this point, the system is deemed to be at its "set point".

Figure 4:
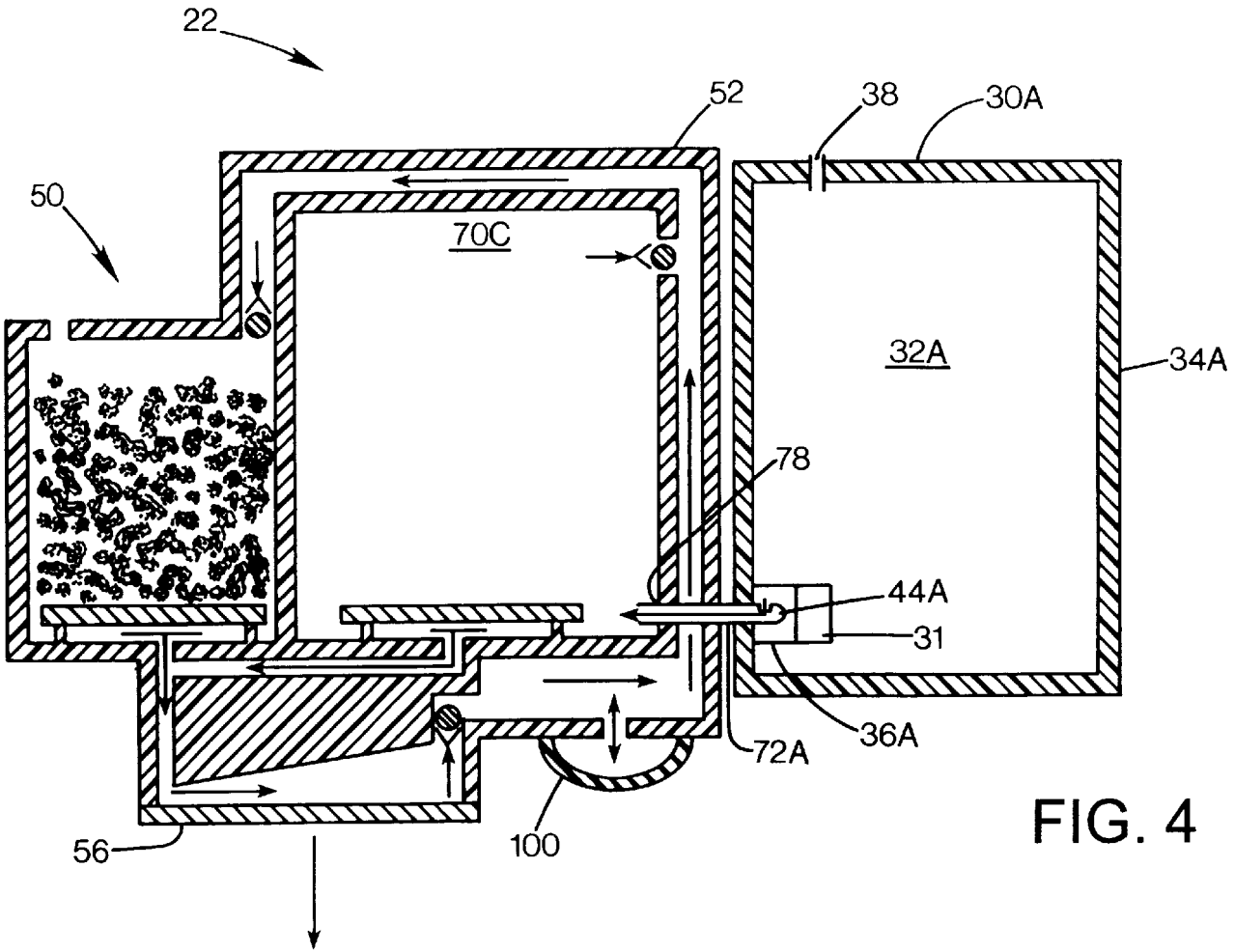
FIG. 4 is a diagrammatic cross-sectional view of an alternate embodiment of a fluid delivery system in accordance with aspects of the invention.

FIG. 4 is a diagrammatic cross-sectional view of an alternate embodiment of a fluid delivery system 22 in accordance with aspects of the invention. The system 22 is a "snapper" system wherein the fluid supply 30A and the print cartridge 50 are carried on the traversing carriage during print operations. The fluid supply 30A is removably connected to the print cartridge 50 by a fluid interconnect, which in an exemplary embodiment is a needle-septum fluid interconnect, wherein the interconnect 72A is a hollow needle 44A protruding from the housing 52, and interconnects with a septum 36A mounted to the housing 34A. Other types of fluid interconnects could alternatively be employed, such as foam-filter or needle-membrane interconnect structures. The needle 44A is in fluid communication with the chamber 70C through an inlet port 78. In other respects, the print cartridge 50 is as described with respect to FIG. 1.

For the case in which the fluid supply 30A is not provided with negative pressure means, an inlet fluid control valve 31 is provided, which can be a check valve which opens only when the pressure applied by the chamber 70C exceeds a break pressure, in the same manner as inlet valve 42 operates in the embodiment of FIGS. 1–2. In such a case, the fluid supply 30A can be held in a flexible bag, or in a rigid container with a vent. Alternatively, the fluid supply can include a means to create a negative pressure, such as a capillary structure or a spring bag structure, in which case the inlet valve can be eliminated. In another alternative, the fluid supply negative pressure is achieved by its height in relation to the printhead 56, e.g. by positioning the fluid supply at a lower height relative to the printhead.

The air purge, pump mode for the embodiment of FIG. 4 is similar to the purge mode for the embodiment of FIGS. 1–2, in that the carriage holding the snapper system is brought to a service station to position the pump diaphragm 100 adjacent a pump actuator. Actuating the pump diaphragm 100 will result in the same operation as described above regarding the embodiment of FIGS. 1–2.

Figure 5:
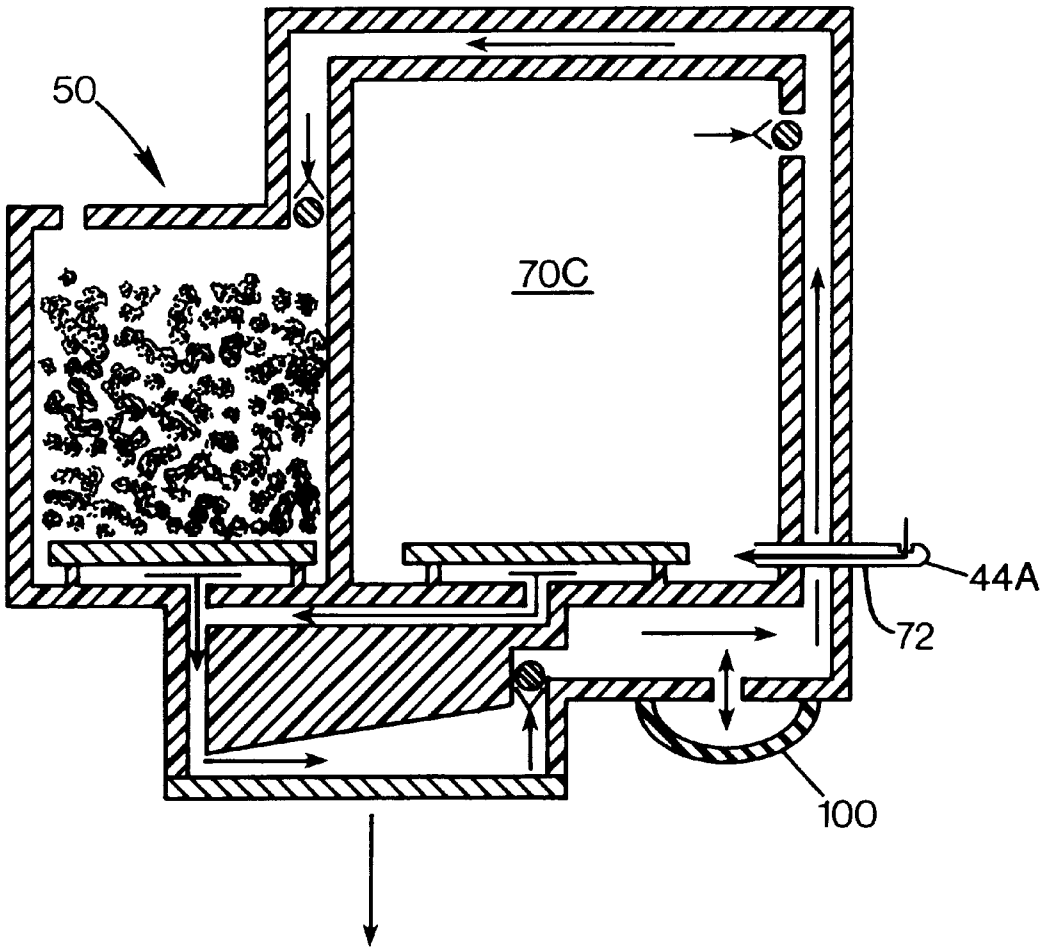
FIGS. 5 and 6 illustrate a further alternate embodiment of a fluid delivery system, wherein the fluid supply is mounted off-axis, and the carriage carrying the print cartridge is periodically moved to a service station.
Figure 6:
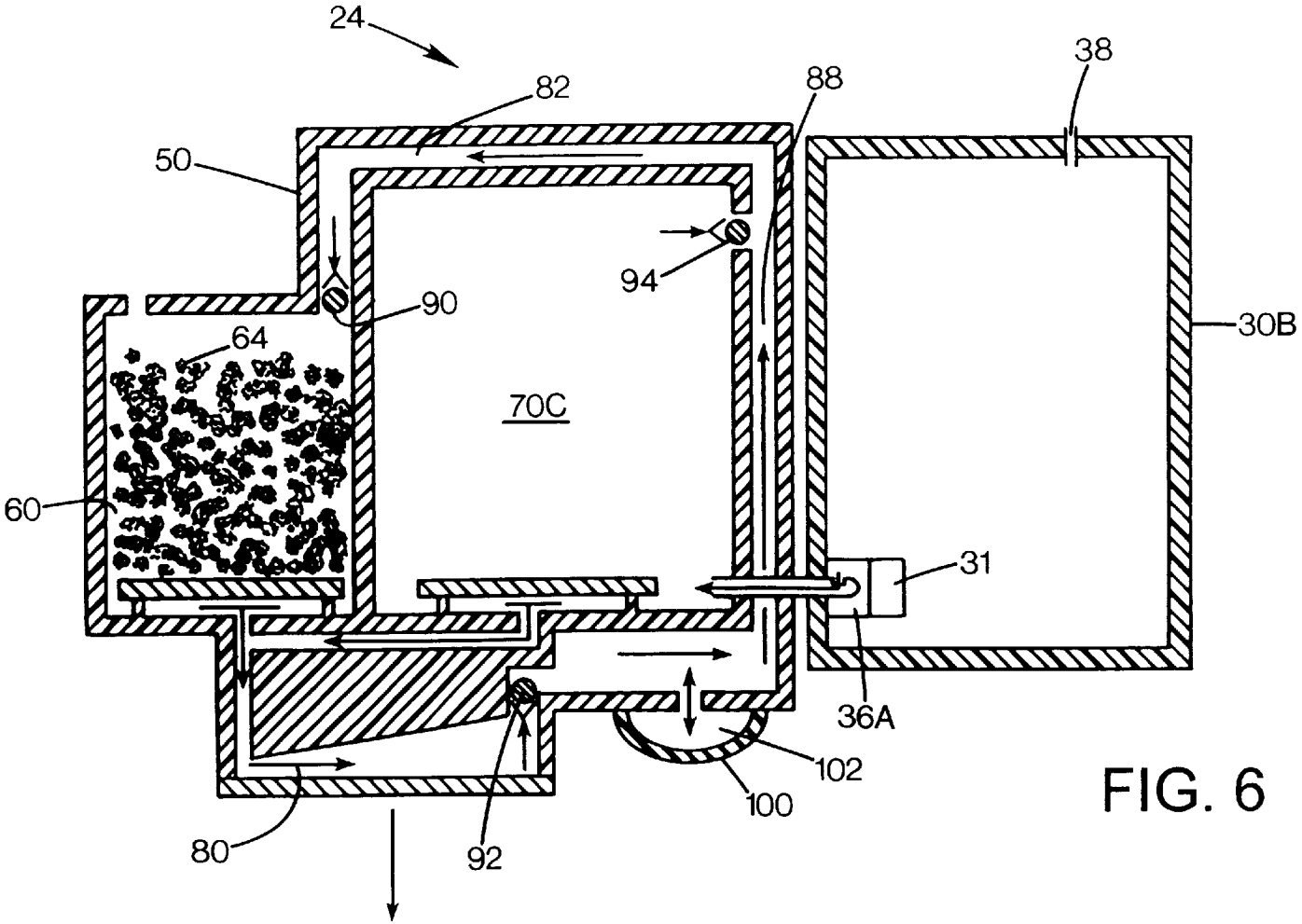

A third embodiment of a fluid delivery system in accordance with aspects of the invention is shown in FIGS. 5 and 6. This is a "take-a-sip" system 24, wherein the fluid supply is mounted off-axis, and the carriage carrying the print cartridge 50 is periodically moved to a service station to establish a fluid interconnection with the fluid supply and to "take-a-sip" to refill the on-axis supply in chamber 70C and to purge air. Thus, the pump diaphragm is activated at the service station to pump fluid and air to purge air from the print cartridge, in a manner similar to that described above regarding the embodiment of FIGS. 1–2.

The print cartridge 50 is as described above with respect to the embodiment of FIG. 4, with the fluid interconnect 72A including a hollow needle 44A for engaging with a septum 36A located in the fluid supply 30B (FIG. 6). For the case in which the fluid supply 30B is not provided with negative pressure means, an inlet valve 31 is provided, which can be a check valve which opens only when the pressure applied by the chamber 70C exceeds a break pressure, in the same manner as inlet valve 42 operates in the embodiment of FIGS. 1–2. In such a case, the fluid supply 30B can be held in a flexible bag, or in a rigid container by, with a vent 38. Alternatively, the fluid supply can include a means to create a negative pressure, such as a capillary structure or a spring bag structure, in which case the inlet valve can be eliminated. In another alternative, the fluid supply negative pressure is achieved by its height in relation to the printhead 56, e.g. by positioning the fluid supply at a lower height relative to the printhead.

The refill/purge operation of the system 24 is as follows. The carriage holding the print cartridge is moved to the service station, and the fluid supply 30B is fluidically connected to the print cartridge 50, if the operation is to include refilling the chamber 70C. If only an air purge is to be conducted, i.e. without refill, the fluid supply is not connected to the print cartridge. This fluidic connection can be accomplished in various ways. For example, the fluid supply can be mounted to a service carriage or sled, which moves on a service axis transverse to the swath axis of the print cartridge carriage. After the print cartridge and carriage are moved to the service station, the service carriage is moved to bring the supply and print cartridge into fluidic connection. Other arrangements could also be employed.

With the cartridge fluidically connected to the fluid supply, the pump actuator is positioned to actuate the pump diaphragm 100. At this state, the pump diaphragm is in a non-compressed state, the pump chamber 102 is full of fluid, and the spring bag chamber 70C and the capillary chamber 60 are at set point, i.e. at the static pressure of the chamber 70C. Now the actuator compresses the pump diaphragm and fluid flows through the fluid channels 88 and 82, opening valve 90 and into the chamber 60. The capillary material 64 is now more saturated than at the set point. When the pump actuator is withdrawn, the pump diaphragm springs back out and fluid/air fills the chamber 102 from the fluid recirculation path 80, drawn from the chamber 70C through purge valve 94, from the capillary structure 62 through valve 92. The spring bag chamber 70C also draws in fluid from the supply 30B if connected. During refill, the spring bag chamber 70C will be at a higher back pressure than the set point, and will refill from the supply 30B as long as the back pressure is great enough to draw fluid. The refill will cease once the back pressure reaches the set point.

During printing at low fluid flux conditions, fluid is taken from the spring bag chamber 70C. During printing at high flux conditions, fluid is drawn from the spring bag chamber 70C and some is also drawn from the capillary chamber 60.

Figure 7:
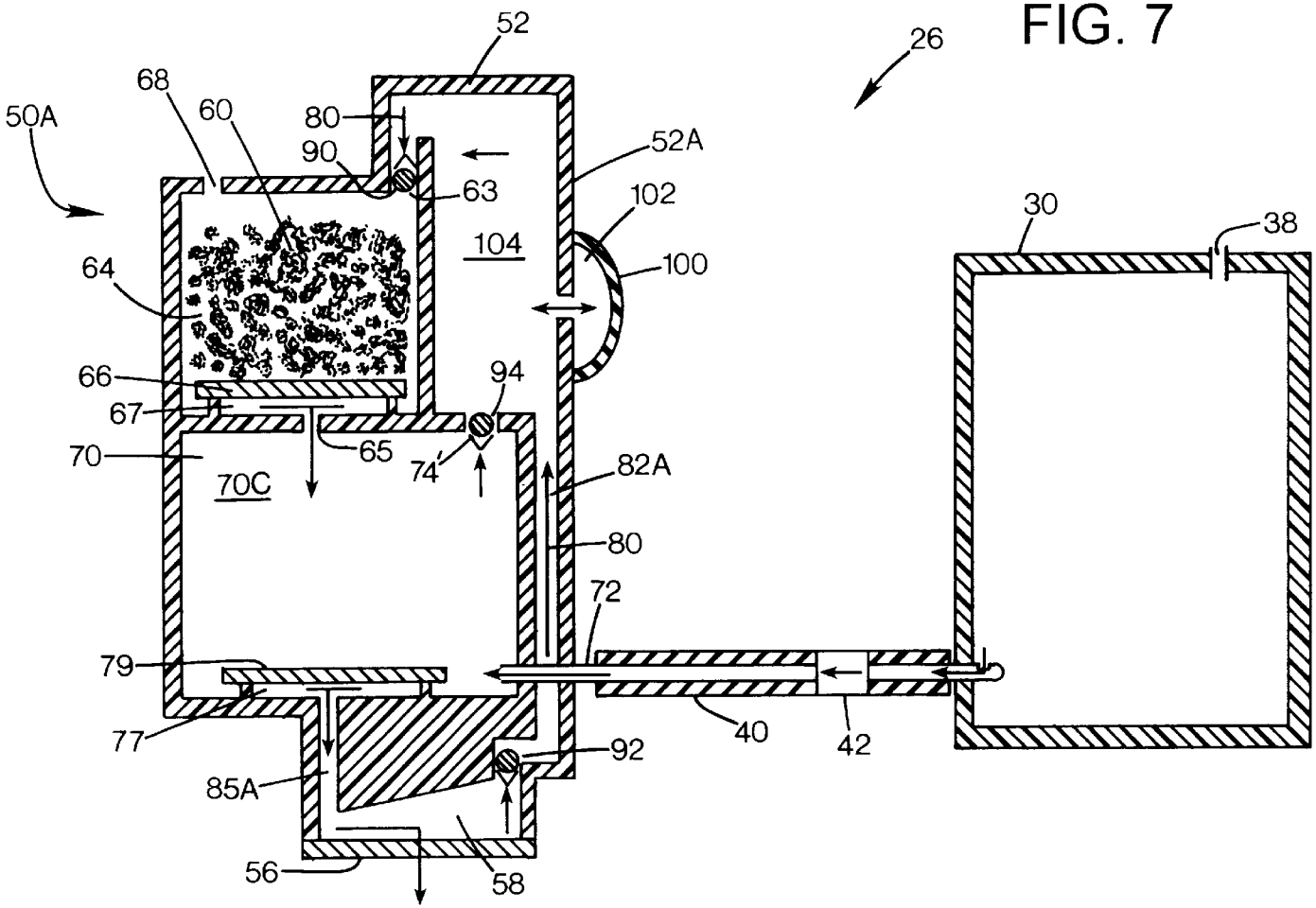
FIG. 7 is a diagrammatic cross-sectional view of yet another alternate embodiment of a fluid delivery system.

FIG. 7 illustrates another embodiment of a fluid delivery system 26. This system employs an off-axis fluid supply 30, connected to a carriage-mounted print cartridge 50A through a tube 40, with an inlet valve 42 disposed in the tube. The fluid supply 30, tube 40 and inlet valve 42 are as described above with respect to the embodiment of FIGS. 1–2. The print cartridge 50A differs from cartridge 50 in that the capillary chamber 60 is located in a series fluid path with and upstream from the spring bag structure 70, so that the capillary chamber feeds the spring bag chamber 70C. Thus, the chamber 60 has disposed therein the filter 66 and output chamber 67, with output port 65 providing fluid communication between the output chamber 67 and the spring bag chamber 70C. The input port 63 to the capillary chamber 60 has check valve 90 disposed therein.

The pump diaphragm 100 is disposed on a side wall 52A of the housing structure 52. As in the print cartridge 50, an end of the tube 40 is connected to a fluid interconnect 72 isolated from a fluid recirculation path 80 and connected to the spring bag chamber 70C.

The fluid recirculation path leads from the plenum 58, through check valve 92, fluid path 82A to chamber 104 and then to the check valve 90. The purge port 74' of the structure 70 has purge check valve 94 disposed therein in an upper wall of the structure 70.

The capillary material 64 in chamber 60 provides a back pressure to the fluid contained therein. The system will maintain a balance between the back pressure provided by the capillary material and the back pressure of the fluid supply, set in this embodiment by the valve 42. During fluid ejection by the printhead 56, fluid emitted from the printhead is replenished from the fluid plenum 58, which in turn is fed by fluid from the spring bag structure 70 through fluid channel 85A after passing through filter 79 and outlet chamber 77. As fluid is drawn from the chamber 70C, the back pressure in the chamber will tend to increase, drawing replacement fluid initially from the capillary chamber 60 through port 65. The capillary material 64 sets a back pressure, in an exemplary embodiment, in a range of −1 to −4 inches of water (full to empty). The fluid supply 30 with valve 42 in this exemplary embodiment has a fluid back pressure of −4 to −8 inches of water. In this example, fluid will be drawn from the capillary chamber 60 into the spring bag chamber 70C during printing operations, until the chamber 70C back pressure reaches −4 to −8 inches of water, at which point, fluid will be drawn into the chamber 70C from the fluid supply 30 through the valve 42. This is because further depletion of the capillary structure would cause its back pressure to rise further, and so the path of least fluid resistance is from the fluid supply 30 through tube 40 and valve 42.

The air purge and fluid replenishment operations for the print cartridge 50A are generally similar to those discussed above regarding print cartridge 50. In this exemplary embodiment, the pump structure 100 is located on a side wall 52A of the housing, and so the pump actuator (not shown in FIG. 7) will operate with a horizontal stroke instead of a vertical stroke. Further the fluid path 80 passes through the spring bag structure 70.

Fluid delivery systems have been described which manage air in the cartridge to enable small-sized, long-life cartridges. An exemplary embodiment of the system enables high ink flux printing capability and the flexibility to put the fluid supplies on-axis or off-axis. In the case of an embodiment wherein the ink supply is located off-axis, and connected to the print cartridge with a fluid conduit or tube, the capability to continuously refill the on-axis reservoir is provided. In an alternate off-axis embodiment, the print cartridge can be intermittently refilled quickly without the added cost and complexity of tubes. In a further alternative embodiment the fluid supply can be connected to the print cartridge in a "snapper" arrangement. The snapper embodiment is a fully re-circulating ink system with an on-axis ink supply. The spring bag provides high ink flux and the capillary material chamber acts both as an air/fluid separator and as a fluid delivery path for periods of low fluid flux printing. The ink supply has back pressure, such as provided by foam, or a fluid height below the printhead. The pump drives the ink to re-circulate from the spring bag and the ink channels.

Exemplary embodiments provide one or more advantages over what has been done before. The regulator or spring bag structure enables higher range of fluid flux over what a simple foam-based system could provide. Faster refill can be provided using the spring bag to drive fluid delivery to an on-axis part of the print cartridge. Faster printer throughout is possible due to continuous refill, if tubes with a regulator are used, since in this embodiment there would be no requirement to stop printing to refill the cartridge. More robust check valves, with higher cracking pressures, can be used in these systems if they are not part of a pressure balance during refill. More ink is available before refill is required in a take-a-sip version, since the spring bag is more volumetrically efficient than capillary material. The capillary material can be very small, since it functions only as an air/ink separator.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A fluid delivery system, comprising:

a print cartridge including:

a housing structure;

an air-fluid separator structure within the housing structure, said separator structure including an air vent region;

a fluid ejector mounted to the housing structure;

a fluid plenum within the housing structure in fluid communication with said fluid ejector;

a free fluid reservoir in the housing structure in fluid communication with the plenum for supplying fluid to the plenum under negative pressure;

a fluid re-circulation path in said housing structure through said separator structure and said fluid plenum;

a pump structure for re-circulating fluid and air through said re-circulation path during a pump mode, wherein air bubbles may be separated from re-circulated fluid and vented to atmosphere from said air vent region; and a fluid supply continuously or intermittently fluidically coupled to said free fluid reservoir for supplying fluid under negative pressure to the free fluid reservoir.

2. The system of claim 1, wherein said fluid re-circulation path has disposed therein at least one check valve permitting fluid flow only in a re-circulation direction.

3. The system of claim 1, wherein said pump structure is mounted to said housing structure.

4. The system of claim 1, wherein the fluid ejector is an inkjet printhead.

5. The system of claim 1 further comprising a fluid interconnect structure for removable connection of the fluid supply to the free fluid reservoir.

6. The system of claim 5 wherein said fluid supply and said free fluid reservoir are continuously connected during printing operations performed by the print cartridge, wherein replenishment fluid is transferred from the fluid supply to said free fluid chamber through the fluid interconnect.

7. The system of claim 6, wherein said print cartridge and said fluid supply are carried by a traversing print cartridge during printing operations.

8. The system of claim 5, wherein the print cartridge is carried by a traversing printer carriage during printing operations, and said fluid supply is mounted off the printer carriage.

9. The system of claim 5, wherein said fluid supply and said print cartridge are intermittently connectable during a refill mode, and are disconnected during printing operations performed by said print cartridge.

10. The system of claim 9, wherein said pump structure is mounted to said cartridge housing.

11. The system of claim 1 further comprising a pump actuator for actuating said pump structure during a refill mode or a recirculation mode.

12. The system of claim 1, wherein the air-fluid separator structure includes a body of capillary material.

13. The system of claim 1, wherein said free fluid reservoir includes a purge port in fluid communication with the re-circulation path through a purge check valve for allowing air and fluid purge during the pump mode.

14. The system of claim 1, wherein the pump structure is disposed adjacent the fluid path between the plenum and said air-fluid separator structure, and wherein a first check valve is disposed in the fluid path between the plenum and the pump structure.

15. The system of claim 14, wherein a second check valve is disposed in the fluid path adjacent an input port to the air-fluid separator structure.

16. The system of claim 15, wherein the pump structure comprises a pump diaphragm, and wherein compression of said diaphragm results in opening said second check valve and fluid flow into the separator structure, and subsequent relaxation of said diaphragm results in closure of the second check valve and opening said first check valve to drawn fluid from the fluid plenum into the fluid path.

17. The system of claim 16, further comprises a purge valve disposed in a purge outlet of the free fluid reservoir to allow fluid and air flow through the purge outlet when the purge valve opens, and said purge valve opens on said subsequent relaxation of said diaphragm.

18. The system of claim 1, wherein said free fluid reservoir includes a spring bag chamber and a flexible wall biased to an extended position by a bias structure.

19. The system of claim 1, wherein said fluid supply is fluidically coupled to said print cartridge through an inlet valve setting a negative pressure within said free fluid reservoir.

20. The system of claim 1, further comprising a fluid channel connecting the air-fluid separator structure and the free fluid reservoir, and wherein under static conditions, negative pressure in said air-fluid separator structure and negative pressure in said free fluid reservoir equalize through fluid flow through said fluid channel.

21. A fluid delivery system, comprising:

a print cartridge including:

a housing structure;

an air-fluid separator structure within the housing structure for separating air bubbles from a fluid and venting the air bubbles from the housing structure;

a fluid ejector mounted to the housing structure;

a fluid plenum within the housing structure in fluid communication with said fluid ejector;

a free fluid reservoir in the housing structure in fluid communication with the plenum and the air-fluid separator structure for supplying fluid to the plenum under negative pressure;

a fluid re-circulation path in said housing structure through said separator structure and said fluid plenum;

a pump structure mounted to the housing structure for re-circulating fluid and air through said re-circulation path during a pump mode, wherein air bubbles may be separated from re-circulated fluid and vented from the housing structure; and a fluid supply fluidically coupled to said free fluid reservoir during fluid ejecting operations for supplying fluid under negative pressure to the free fluid reservoir.

22. The system of claim 21, wherein said fluid re-circulation path has disposed therein at least one check valve permitting fluid flow only in a re-circulation direction.

23. The system of claim 21, wherein the fluid ejector is an inkjet printhead.

24. The system of claim 21 further comprising a fluid interconnect structure for removable connection of the fluid supply to the free fluid reservoir.

25. The system of claim 21, wherein the print cartridge is carried by a traversing printer carriage during printing operations, and said fluid supply is mounted off the printer carriage.

26. The system of claim 21 further comprising a pump actuator for actuating said pump structure during a refill mode or a recirculation mode.

27. The system of claim 21, wherein the air-fluid separator structure includes a body of capillary material.

28. The system of claim 21, wherein the pump structure is disposed in the fluid path between the plenum and said air-fluid separator structure, and wherein a first check valve is disposed in the fluid path between the plenum and the pump structure.

29. The system of claim 28, wherein a second check valve is disposed in the fluid path adjacent an input port to the air-fluid separator structure.

30. The system of claim 29, wherein the pump structure comprises a pump diaphragm, and wherein compression of said diaphragm results in opening said second check valve and fluid flow into the separator structure, and subsequent relaxation of said diaphragm results in closure of the second check valve and opening said first check valve to drawn fluid from the fluid plenum into the fluid path.

31. The system of claim 30, further comprises a purge valve disposed in a purge outlet of the free fluid reservoir to allow fluid and air flow through the purge outlet when the purge valve opens, and said purge valve opens on said subsequent relaxation of said diaphragm.

32. The system of claim 21, wherein said free fluid reservoir includes a spring bag chamber and a flexible wall biased to an extended position by a bias structure.

33. The system of claim 21, wherein said fluid supply is fluidically coupled to said print cartridge through an inlet check valve setting a negative pressure within said free fluid reservoir.

34. A fluid delivery system, comprising:

a print cartridge including:

a housing structure;

a fluid ejector mounted to the housing structure;

an air-fluid separator structure within the housing structure for separating air bubbles from a fluid and venting the air bubbles from the housing structure;

a fluid plenum within the housing structure in fluid communication with said fluid ejector;

a free fluid reservoir in the housing structure in fluid communication with the plenum and the air-fluid separator for supplying fluid to the plenum under negative pressure;

a fluid re-circulation path in said housing structure through said separator structure, said free fluid reservoir and said fluid plenum;

a pump structure mounted to the housing structure for re-circulating fluid and air through said re-circulation path during a pump mode, wherein fluid is passed through said air fluid separator structure, said free fluid reservoir and said plenum to purge air bubbles from the fluid and housing structure; and a fluid supply fluidically coupled to said free fluid reservoir during fluid ejecting operations for supplying fluid under negative pressure to the free fluid reservoir.

35. The system of claim 34, wherein the pump structure is disposed in the fluid path between the plenum and said air-fluid separator structure, and wherein a first check valve is disposed in the fluid path at a plenum outlet port permitting fluid flow only in a direction from the plenum to the air-fluid separator structure when a first differential valve pressure is exceeded.

36. The system of claim 35, wherein a second check valve is disposed in the fluid path adjacent an input port to the air-fluid separator structure permitting fluid flow only in a direction from the plenum to the air-separator structure when a second differential valve pressure is exceeded.

37. The system of claim 36, wherein the pump structure comprises a pump diaphragm, and wherein compression of said diaphragm results in opening said second check valve and fluid flow into the separator structure, and subsequent relaxation of said diaphragm results in closure of the second check valve and opening said first check valve to drawn fluid from the fluid plenum into the fluid path.

38. The system of claim 37, further comprises a purge valve disposed in a purge outlet of the free fluid reservoir to allow fluid and air flow through the purge outlet when the purge valve opens, and said purge valve opens on said subsequent relaxation of said diaphragm.

39. The system of claim 34, wherein said free fluid reservoir includes a spring bag chamber and a flexible wall biased to an extended position by a bias structure.

40. The system of claim 39, wherein said fluid supply is fluidically coupled to said print cartridge through an inlet check valve setting a negative pressure within said free fluid reservoir.

* * * * *